US008054998B2

(12) United States Patent
Okamura et al.

(10) Patent No.: US 8,054,998 B2
(45) Date of Patent: Nov. 8, 2011

(54) MULTICHANNEL AMPLIFIER

(75) Inventors: Toshifumi Okamura, Neyagawa (JP); Norio Etoh, Neyagawa (JP)

(73) Assignee: Onkyo Corporation, Neyagawa-shi (JP)

( * ) Notice: Subject to any disclaimer, the term of this patent is extended or adjusted under 35 U.S.C. 154(b) by 855 days.

(21) Appl. No.: 12/051,048

(22) Filed: Mar. 19, 2008

(65) Prior Publication Data

US 2008/0279402 A1 Nov. 13, 2008

(30) Foreign Application Priority Data

May 11, 2007 (JP) ..... 2007-127409

(51) Int. Cl.
*H04R 5/02* (2006.01)

(52) U.S. Cl. ..... 381/307; 381/74; 381/102; 381/104; 381/123; 381/309

(58) Field of Classification Search ..... 381/74, 381/123, 120, 72, 307, 309, 370, 102–109
See application file for complete search history.

(56) References Cited

U.S. PATENT DOCUMENTS

| | | | | |
|---|---|---|---|---|
| 6,069,960 | A * | 5/2000 | Mizukami et al. | 381/74 |
| 6,148,085 | A * | 11/2000 | Jung | 381/104 |
| 6,167,140 | A * | 12/2000 | Watanabe | 381/123 |
| 6,266,571 | B1 * | 7/2001 | Fado et al. | 700/94 |
| 6,954,675 | B2 * | 10/2005 | Chu et al. | 700/94 |
| 7,742,610 | B1 * | 6/2010 | Hibino et al. | 381/302 |
| 2002/0128738 | A1 * | 9/2002 | Chu et al. | 700/94 |
| 2009/0016539 | A1 * | 1/2009 | Watanabe | 381/22 |
| 2009/0022337 | A1 * | 1/2009 | Sakai et al. | 381/104 |

FOREIGN PATENT DOCUMENTS

| | | |
|---|---|---|
| JP | 59-166591 | 11/1984 |
| JP | 63-68293 | 5/1988 |
| JP | 3-59796 | 6/1991 |
| JP | 103699 | 10/1991 |
| JP | 6-113390 | 4/1994 |
| JP | 8-152895 | 6/1996 |
| JP | 08-205276 | 8/1996 |
| JP | 8-205276 | 8/1996 |
| JP | 10-013987 | 1/1998 |
| JP | 10-13987 | 1/1998 |
| JP | 10-336786 | 12/1998 |
| JP | 2003-058977 | 2/2003 |
| JP | 2005-124106 | 5/2005 |
| JP | 2006-121595 | 5/2006 |

* cited by examiner

*Primary Examiner* — Kiesha Bryant
*Assistant Examiner* — Dmitriy Yemelyanov
(74) *Attorney, Agent, or Firm* — Renner, Otto, Boisselle & Sklar, LLP

(57) ABSTRACT

In a multichannel amplifier according to the present invention, in a case where a headphone is not connected to a headphone output terminal, a switch IC and first to third switches are on/off controlled by a control unit so that an audio signal path for outputting a front channel signal FL/FR to a front speaker and extending from a first input terminal 1 to a front speaker output terminal 6 via a buffer circuit 10*a*, a switch IC 9, a first volume control unit 3*a*, a buffer circuit 10*b*, and a first amplifying unit 4*a* is not electrically connected to another audio signal path.

3 Claims, 2 Drawing Sheets

[Fig. 1]
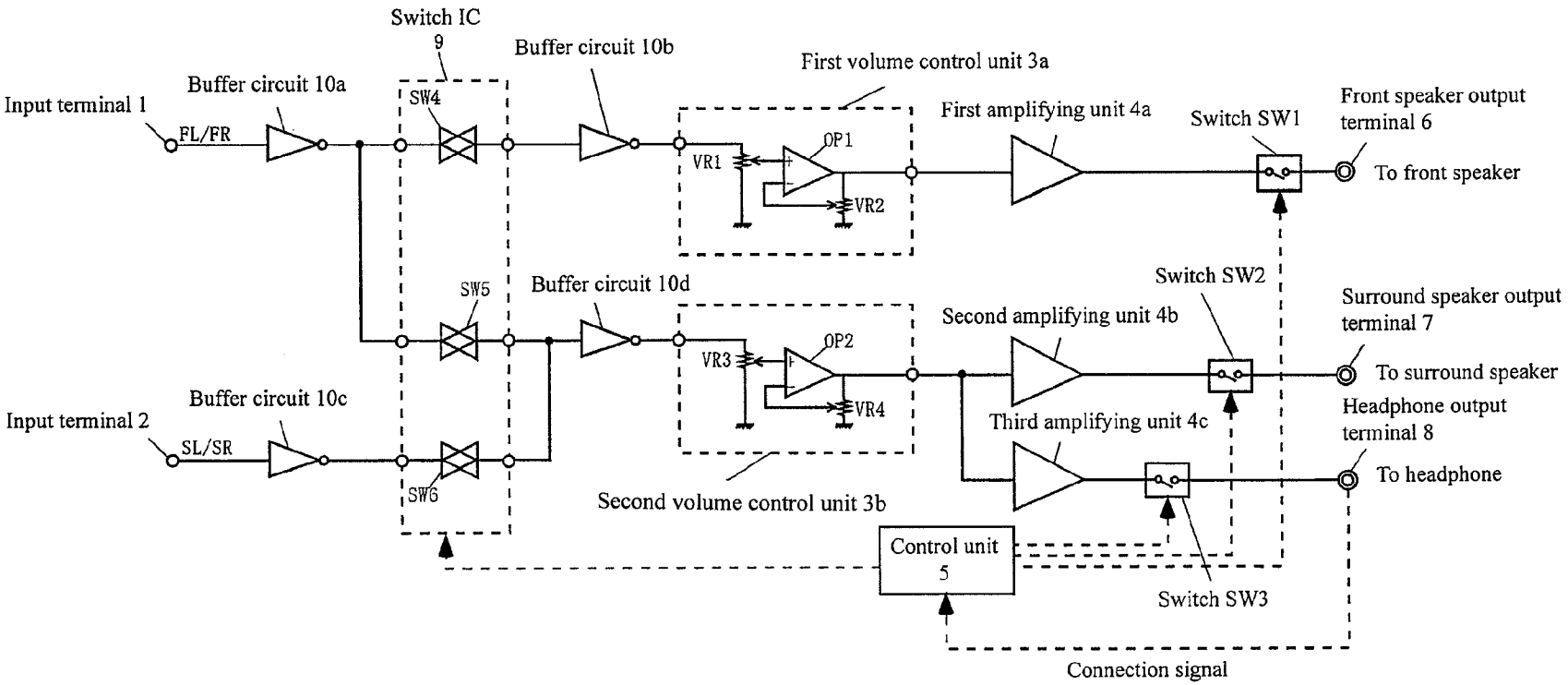

[Fig. 2]
| | | Switch SW1 | Switch SW2 | Switch SW3 | Switch IC9 | | |
|---|---|---|---|---|---|---|---|
| | | | | | Switch SW4 | Switch SW5 | Switch SW6 |
| Headphone non-connection state (no connection signal is supplied) | Output to front speaker and surround speaker | ON | ON | OFF | ON | OFF | ON |
| | Output only to front speaker | | OFF | OFF | | | OFF |
| Headphone connection state (connection signal is supplied) | | ON/OFF | OFF | ON | OFF | ON | OFF |
[Fig. 3]
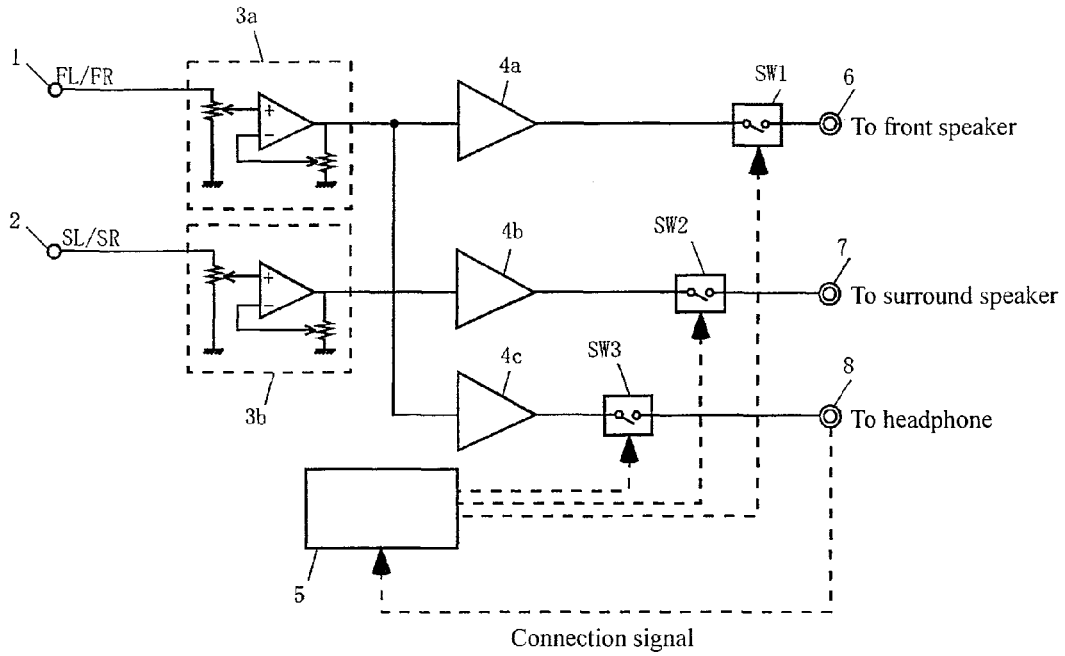

MULTICHANNEL AMPLIFIER

BACKGROUND OF THE INVENTION

1. Field of the Invention

The present invention relates to a multichannel amplifier having an amplifying unit for a headphone.

2. Description of the Related Art

A conventional multichannel amplifier will be described. FIG. 3 is a circuit diagram showing a schematic configuration of the conventional multichannel amplifier. The conventional multichannel amplifier has a volume control unit 3*a* for a front channel, a volume control unit 3*b* for a surround channel, an amplifying unit 4*a* for a front channel, an amplifying unit 4*b* for a surround channel, an amplifying unit 4*c* for a headphone, a control unit 5, an output terminal 6 for a front speaker, an output terminal 7 for a surround speaker, an output terminal 8 for a headphone, and switches SW1 to SW3.

To the front channel volume control unit 3*a*, a front channel signal FL/FR as an analog audio signal is inputted via an input terminal 1. The front channel volume control unit 3*a* controls the level of the front channel signal FL/FR and outputs the resultant signal to the front channel amplifying unit 4*a*. The front channel amplifying unit 4*a* amplifies the front channel signal FL/FR and outputs the amplified signal to the front speaker output terminal 6 via the switch SW1. The front channel signal FL/FR is outputted to a front speaker connected to the front speaker output terminal 6 and converted to sound.

To the surround channel volume control unit 3*b*, an analog surround channel signal SL/SR is inputted via an input terminal 2. The surround channel volume control unit 3*b* controls the level of the surround channel signal SL/SR and outputs the resultant signal to the surround channel amplifying unit 4*b*. The surround channel amplifying unit 4*b* amplifies the surround channel signal SL/SR and outputs the amplified signal to the surround speaker output terminal 7 via the switch SW2. The surround channel signal SL/SR is outputted to a surround speaker connected to the surround speaker output terminal 7 and converted to sound.

An input terminal of the headphone amplifying unit 4*c* is connected in parallel with the front channel amplifying unit 4*a* at the rear stage of the front channel volume control unit 3*a*. The front channel signal FL/FR whose level is controlled by the front channel volume control unit 3*a* is inputted to the headphone amplifying unit 4*c*. The headphone amplifying unit 4*c* amplifies the inputted front channel signal FL/FR and outputs the amplified signal to the headphone output terminal 8 via the switch SW3. The front channel signal FL/FR is outputted to a headphone connected to the headphone output terminal 8 and converted to sound.

When the headphone is connected, the headphone output terminal 8 outputs a connection signal indicative of the connection between the headphone and the headphone output terminal 8 to the control unit 5. The control unit 5 detects the connection signal outputted from the headphone output terminal 8 and, based on the connection signal, turns on/off the switches SW1 to SW3.

In a case where no headphone is connected to the headphone output terminal 8, the control unit 5 turns on the switches SW1 and SW2 and turns off the switch SW3 so that the front channel signal FL/FR and the surround channel signal SL/SR are outputted to the front speaker and the surround speaker, respectively. In a case where the headphone is connected to the headphone output terminal 8, the control unit 5 turns off the switches SW1 and SW2 and turns on the switch SW3 so that the front channel signal FL/FR is outputted to the headphone.

In such a conventional multichannel amplifier, even in a case where no headphone is connected to the headphone output terminal 8, the headphone amplifying unit 4*c* is connected in parallel with the front channel amplifying unit 4*a* at the rear stage of the front channel volume control unit 3*a*. There is, consequently, a problem such that the input impedance of the front channel amplifying unit 4*a* drops and a wire to the headphone amplifying unit 4*c* becomes an inductor component, thereby deteriorating the sound quality.

Consequently, a relay is provided at the front stage of each of the front channel amplifying unit 4*a* and the headphone amplifying unit 4*c*. When no headphone is connected to the headphone output terminal 8, by turning on/off the relays, the front channel amplifying unit 4*a* and the headphone amplifying unit 4*c* are set to an electrically-not-connected state, and the problem is solved. However, the relays are expensive, so that a problem of increase in cost occurs.

SUMMARY OF THE INVENTION

The present invention has been achieved to solve the problems of the conventional technique and an object of the present invention is to provide a multichannel amplifier having an amplifier for a headphone and, even in a case where no headphone is used, realizing higher quality of sound outputted from a front speaker without an adverse influence of an audio signal path to the headphone exerted on an audio signal path to the front speaker.

A multichannel amplifier as a preferred embodiment of the present invention includes: a first input terminal to which a front channel signal is inputted; a second input terminal to which a surround channel signal is inputted; a first volume control unit to which the front channel signal is inputted and which controls level of the front channel signal; a second volume control unit to which the front channel signal or the surround channel signal is inputted and which controls level of the front channel signal or the surround channel signal; a first amplifying unit connected to the first volume control unit, amplifying the front channel signal supplied from the first volume control unit, and outputting the amplified front channel signal to a front speaker; a second amplifying unit connected to the second volume control unit, amplifying the surround channel signal supplied from the second volume control unit, and outputting the amplified surround channel signal to a surround speaker; a third amplifying unit connected to the second volume control unit in parallel with the second amplifying unit and amplifying the front channel signal supplied from the second volume control unit; a headphone output terminal to which a headphone can be connected and from which the front channel signal supplied from the third amplifying unit is outputted; a first switch unit for switching a first path extending from the first input terminal to the front speaker via the first volume control unit and the first amplifying unit to a connection state or a non-connection state; a second switch unit for switching a second path extending from the first input terminal to the second volume control unit to the connection state or the non-connection state; a third switch unit for switching a third path extending from the second input terminal to the second volume control unit to the connection state or the non-connection state; a fourth switch unit for switching a fourth path extending from the second volume control unit to the surround speaker via the second amplifying unit to the connection state or the non-connection state; a fifth switch unit for switching a fifth path extending from the second volume control unit to the headphone output terminal via the third amplifying unit to the connection state or the non-connection state; and a control unit for controlling switching between the connection state and the non-connection state of the first to fifth paths based on whether the headphone is connected to the headphone output terminal or not. When the headphone is not connected to the headphone output terminal, the control unit controls the first and second switch units so that the first path is in the connection state and the second path is in the non-connection state.

In a further preferred embodiment, the first switch unit includes a switch unit for switching connection between the first input terminal and the first volume control unit to the connection state or the non-connection state and, when the headphone is connected to the headphone output terminal, the switch unit and the second to fifth switches are controlled so that the first path, the third path, and the fourth path enter the non-connection state, and the second path and the fifth path enter the connection state.

In a further preferred embodiment, a first buffer circuit is connected between the first input terminal and the switch unit and the second switch unit, a second buffer circuit is connected between the switch unit and the first volume control unit, a third buffer circuit is connected between the second input terminal and the third switch unit, and a fourth buffer circuit is connected between the second and third switch units and the second volume control unit.

According to the present invention, when a headphone is not used (that is, sound is outputted from the front speaker) in the multichannel amplifier having the amplifying unit for the headphone, the audio signal path to the front speaker and the audio signal path to the headphone are not connected to each other. Consequently, the audio signal path to the front speaker is not influenced by the signal path to the headphone, and the multichannel amplifier realizing higher quality of sound outputted from the front speaker can be provided.

BRIEF DESCRIPTION OF THE DRAWINGS

FIG. 1 is a circuit diagram showing a multichannel amplifier according to a preferred embodiment of the present invention.

FIG. 2 is a diagram showing control on switches performed by a control unit in the preferred embodiment of the present invention.

FIG. 3 is a circuit diagram showing a conventional multichannel amplifier.

DETAILED DESCRIPTION OF THE PREFERRED EMBODIMENTS

A multichannel amplifier according to preferred embodiments of the present invention will be described hereinbelow, but the invention is not limited to the embodiments. The same reference numerals are given to the same or corresponding parts in the diagrams and their repetitive description will not be given.

First, referring to FIG. 1, a schematic configuration of a multichannel amplifier of the present invention will be described. FIG. 1 is a circuit diagram showing a multichannel amplifier according to a preferred embodiment of the invention.

A multichannel amplifier has a first input terminal 1, a second input terminal 2, a first volume control unit 3*a*, a second volume control unit 3*b*, a first amplifying unit 4*a*, a second amplifying unit 4*b*, a third amplifying unit 4*c*, a control unit 5, a front speaker output terminal 6 to which a front speaker (not shown) is connected, a surround speaker output terminal 7 to which a surround speaker (not shown) is connected, a headphone output terminal 8 to which a headphone (not shown) is connected, switches SW1 to SW3, a switch IC 9, and buffer circuits 10*a* to 10*d*.

A front channel signal FL/FR as an analog audio signal is inputted from the outside to the first input terminal 1, and a surround channel signal SL/SR as an analog audio signal is inputted from the outside to the second input terminal 2.

The first volume control unit 3*a* controls the level of the front channel signal FL/FR inputted from the first input terminal 1 and outputs the resultant signal to the first amplifying unit 4*a*. In the embodiment, the first volume control unit 3*a* includes an operational amplifier OP1, and an output terminal of the operational amplifier OP1 is connected to the output terminal of the volume control unit 3*a*. A positive-phase input terminal of the operational amplifier OP1 is connected to a wiper of a variable resistor VR1 connected to the input terminal of the volume control unit 3*a* and grounded. The opposite-phase input terminal of the operational amplifier OP1 is connected between the output terminal of the operational amplifier OP1 and the output terminal of the volume control unit 3*a* and grounded, and is also connected to a wiper of a variable resistor VR2. To the opposite-phase input terminal, the level-controlled front channel signal FL/FR is inputted as a feedback signal.

The second volume control unit 3*b* controls the level of the front channel signal FL/FR inputted from the first input terminal 1 or the surround channel signal SL/SR inputted from the second input terminal 2, and outputs the resultant signal to the second amplifying unit 4*b* or the third amplifying unit 4*c*. In the embodiment, the second volume control unit 3*b* includes an operational amplifier OP2, and the output terminal of the operational amplifier OP2 is connected to the output terminal of the volume control unit 3*b*. The positive-phase input terminal of the operational amplifier OP2 is connected to a wiper of a variable resistor VR3 connected to the input terminal of the volume control unit 3*b* and grounded. The opposite-phase input terminal of the operational amplifier OP2 is connected to a wiper of a variable resistor VR4 connected between the output terminal of the operational amplifier OP2 and the output terminal of the volume control unit 3*b* and grounded. To the opposite-phase input terminal, the level-controlled front channel signal FL/FR or surround channel signal SL/SR is inputted as a feedback signal.

The first amplifying unit 4*a* is connected at the rear stage of the first volume control unit 3*a*. The first amplifying unit 4*a* amplifies the front channel signal FL/FR whose level is controlled by the first volume control unit 3*a* and outputs the amplified signal to the front speaker output terminal 6. The second amplifying unit 4*b* is connected at the rear stage of the second volume control unit 3*b*. The second amplifying unit 4*b* amplifies the surround channel signal SL/SR whose level is controlled by the second volume control unit 3*b* and outputs the amplified signal to the surround speaker output terminal 7. The third amplifying unit 4*c* is connected at the rear stage of the second volume control unit 3*b* in parallel with the second amplifying unit 4*c*. The third amplifying unit 4*c* amplifies the front channel signal FL/FR whose level is controlled by the second volume control unit 3*b* and outputs the amplified signal to the headphone output terminal 8.

The switch SW1 switches an output path extending from the first amplifying unit 4*a* to the front speaker to a connection state or a non-connection state. In other words, the switch SW1 is connected between the first amplifying unit 4*a* and the front speaker output terminal 6 to permit or inhibit supply of the front channel signal FL/FR outputted from the first amplifying unit 4*a* to the front speaker output terminal 6. Specifically, when the switch SW1 is turned on, the front channel signal FL/FR output from the first amplifying unit 4*a* is supplied to the front speaker output terminal 6. When the switch SW1 is turned off, supply of the front channel signal FL/FR to the front speaker output terminal 6 is interrupted.

The switch SW2 switches an output path extending from the second amplifying unit 4*b* to the surround speaker to a connection state or a non-connection state. In other words, the switch SW2 is connected between the second amplifying unit 4*b* and the surround speaker output terminal 7 to permit or inhibit supply of the surround channel signal SL/SR outputted from the second amplifying unit 4*b* to the surround speaker output terminal 7. Specifically, when the switch SW2 is turned on, the surround channel signal SL/SR outputted from the second amplifying unit 4*b* is supplied to the surround speaker output terminal 7. When the switch SW2 is turned off, supply of the surround channel signal SL/SR to the surround speaker output terminal 7 is interrupted.

The switch SW3 switches an output path extending from the third amplifying unit 4*c* to the headphone to a connection state or a non-connection state. In other words, the switch SW3 is connected between the third amplifying unit 4*c* and the headphone output terminal 8 to permit or inhibit supply of the front channel signal FL/FR outputted from the third amplifying unit 4*c* to the headphone output terminal 8. Specifically, when the switch SW3 is turned on, the front channel signal FL/FR outputted from the third amplifying unit 4*c* is supplied to the headphone output terminal 8. When the switch SW3 is turned off, supply of the front channel signal FL/FR to the headphone output terminal 8 is interrupted.

The switch IC 9 is connected between the first input terminal 1 or the second input terminal 2 and the first volume control unit 3*a* or the second volume control unit 3*b*, switches an input path from the first input terminal 1 to the first volume control unit 3*a* to the connection state or the non-connection state, switches an input path extending from the first input terminal 1 to the second volume control unit 3*b* to the connection state or the non-connection state, and switches an input path from the second input terminal 2 to the second volume control unit 3*b* to the connection state or the non-connection state.

The switch IC 9 includes switches SW4 to SW6. The switch SW4 is connected between the first input terminal 1 and the first volume control unit 3*a* and switches an input path from the first input terminal 1 to the first volume control unit 3*a* to the connection state or the non-connection state. In other words, the switch SW4 is provided to permit or inhibit supply of the front channel signal FL/FR inputted from the first input terminal 1 to the first volume control unit 3*a*. That is, when the switch SW4 is turned on, the front channel signal FL/FR inputted from the first input terminal 1 is supplied to the first volume control unit 3*a*. When the switch SW4 is turned off, supply of the front channel signal FL/FR to the first volume control unit 3*a* is interrupted. The switch SW5 is connected between the first input terminal 1 and the second volume control unit 3*b* and switches an input path from the first input terminal 1 to the second volume control unit 3*b* to the connection state or the non-connection state. In other words, the switch SW5 is provided to permit or inhibit supply of the front channel signal FL/FR inputted from the first input terminal 1 to the second volume control unit 3*b*. That is, when the switch SW5 is turned on, the front channel signal FL/FR inputted from the first input terminal 1 is supplied to the second volume control unit 3*b*. When the switch SW5 is turned off, supply of the front channel signal FL/FR to the second volume control unit 3*b* is interrupted. The switch SW6 is connected between the second input terminal 2 and the second volume control unit 3*b* and switches an input path from the second input terminal 2 to the second volume control unit 3*b* to the connection state or the non-connection state. In other words, the switch SW6 is provided to permit or inhibit supply of the surround channel signal SL/SR inputted from the second input terminal 2 to the second volume control unit 3*b*. That is, when the switch SW6 is turned on, the surround channel signal SL/SR inputted from the second input terminal 2 is supplied to the second volume control unit 3*b*. When the switch SW6 is turned off, supply of the surround channel signal SL/SR to the second volume control unit 3*b* is interrupted.

The buffer circuit 10*a* is connected between the first input terminal 1 and the switch IC 9, and the buffer circuit 10*c* is connected between the second input terminal 2 and the switch IC 9. The buffer circuit 10*b* is connected between the switch IC 9 and the first volume control unit 3*a*, and the buffer circuit 10*d* is connected between the switch IC 9 and the second volume control unit 3*b*.

A headphone is connected to the headphone output terminal 8. When the headphone is connected, the headphone output terminal 8 outputs a connection signal indicative of connection between the headphone and the headphone output terminal 8 to the control unit 5.

Based on whether the headphone is connected to the headphone output terminal 8 or not, the control unit 5 controls to output the front channel signal FL/FR or the surround channel signal SL/SR to the speaker and/or the headphone. In other words, depending on whether the headphone is connected to the headphone output terminal 8 or not, in the switch IC 9 the control unit 5 controls switching between the connection state and the non-connection state of the input path from the first input terminal 1 to the first volume control unit 3*a*, the input path from the first input terminal 1 to the second volume control unit 3*b*, and the input path from the second input terminal 2 to the second volume control unit 3*b*. In the switches SW1 to SW3 the control unit 5 controls switching between the connection state and the non-connection state of the output path extending from the first amplifying unit 4*a* to the front speaker, the output path extending from the second amplifying unit 4*b* to the surround speaker, and the output path extending from the third amplifying unit 4*c* to the headphone. Concretely, based on the presence/absence of the connection signal from the headphone output terminal 8, the switches SW1 to SW3 are on/off controlled, and the switches SW4 to SW6 of the switch IC 9 are on/off controlled. The control unit 5 also controls the level of an audio signal in the first and second volume control units 3*a* and 3*b*.

The operation of the multichannel amplifier having the above configuration will now be described.

The control unit 5 determines whether the headphone is connected to the headphone output terminal 8 or not. Concretely, the control unit 5 determines whether a headphone is connected to the headphone output terminal 8 or not depending on whether the connection signal is inputted from the headphone output terminal 8 or not. When the connection signal is inputted from the headphone output terminal 8, it is determined that the headphone is connected to the headphone output terminal 8.

FIG. 2 is a diagram showing control on the switches SW1 to SW3 and the switches SW4 to SW6 in the switch IC 9 performed by the control unit 5. When it is determined that no headphone is connected to the headphone output terminal 8, the control unit 5 turns on the switch SW1 and the switch SW4 in the switch IC 9, and turns off the switch SW5 in the switch IC 9. By the operation, the input path extending from the first input terminal 1 to the second volume control unit 3*b* enters the non-connection state, and the front channel signal FL/FR inputted from the first input terminal 1 reaches the first amplifying unit 4*a* via the buffer circuit 10*a*, the switch IC 9, the first volume control unit 3*a*, and the buffer circuit 10*b* and is outputted to the front speaker output terminal 6. With respect to the switches SW2 and SW3 and the switch SW6 in the switch IC 9, in a case of outputting sound only from the front speaker, the switch SW6 in the switch IC 9 is turned off, or the switches SW2 and SW3 are turned off. In a case of outputting sound also from the surround speaker, the switch SW2 and the switch SW6 in the switch IC 9 are turned on, and the switch SW3 is turned off.

In a case where the control unit 5 determines that the headphone is connected to the headphone output terminal 8, the switches SW1 and SW2, and the switches SW4 and SW6 in the switch IC 9 are turned off, and the switch SW3 and the switch SW5 in the switch IC 9 are turned on. By the operation, the input path extending from the first input terminal 1 to the first volume control unit 3*a* and the input path extending from the second input terminal 2 to the second volume control unit 3*b* enter the non-connection state, and the front channel signal FL/FR inputted from the first input terminal 1 reaches the third amplifying unit 4*c* via the buffer circuit 10*a*, the switch IC 9, the buffer circuit 10*d*, and the second volume control unit 3*b*, and is outputted to the headphone output terminal 8.

In the multichannel amplifier of the present invention, in a case where no headphone is connected to the headphone output terminal 8, the switch IC 9 and the switches SW1 to SW3 are on/off-controlled by the control unit 5 so that an audio signal path extending from the first input terminal 1 to the front speaker output terminal 6 via the buffer circuit 10*a*, the switch IC 9, the first volume control unit 3*a*, the buffer circuit 10*b*, and the first amplifying unit 4*a* is not electrically connected to another audio signal path. As a result, without an adverse influence exerted in a case where another audio signal path (particularly, an audio signal path to the headphone including the third amplifying unit 4*c*) is connected to the audio signal path to the front speaker, that is, drop in the input impedance of the first amplifying unit 4*a*, and generation of the inductor component by wiring, higher quality of sound outputted from the front speaker can be realized.

Further, in a case where the headphone is connected to the headphone output terminal 8, the multichannel amplifier according to the present invention turns on/off the switch IC 9 and the switches SW1 to SW3 by the control unit 5 so that an audio signal path for outputting the front channel signal FL/FR to the headphone and extending from the first input terminal 1 to the headphone output terminal 8 via the buffer circuit 10*a*, the switch IC 9, the second volume control unit 3*b*, the buffer circuit 10*d*, and the third amplifying unit 4*c* is not electrically connected to the audio signal path to the front speaker, including the first volume control unit 3*a* and the first amplifying unit 4*a* and the input terminal 2. As a result, without an adverse influence exerted in the case where the audio signal path to the front speaker and the input terminal 2 are connected to the audio signal path to the headphone, that is, drop in the input impedance of the third amplifying unit 4*c*, and generation of the inductor component by wiring can be suppressed and higher quality of sound outputted from the headphone can be realized.

The multichannel amplifier of the present invention can be manufactured at low cost for the reason that a switch IC, not a relay, is used as a unit for switching between the connection state and the non-connection state of the input path extending from the first input terminal 1 to the first volume control unit 3*a* or the second volume control unit 3*b*, and the input path from the second input terminal 2 to the second volume control unit 3*b*.

By connecting the buffer circuit 10*a* between the first input terminal 1 and the switch IC 9, connecting the buffer circuit 10*c* between the second input terminal 2 and the switch IC 9, connecting the buffer circuit 10*b* between the switch IC and the first volume control unit 3*a*, and connecting the buffer circuit 10*d* between the switch IC and the second volume control unit 3*b*, distortion in an output of the multichannel amplifier caused by the influence of the switch IC 9 can be suppressed. As a result, higher quality of sound outputted from the front speaker can be achieved, and higher quality of sound outputted from the surround speaker can be achieved.

In the embodiment, in a case where the control unit 5 determines that the headphone is connected to the headphone output terminal 8, the switches SW1 and SW2, and the switches SW4 and SW6 in the switch IC 9 are turned off, and the switch SW3 and the switch SW5 in the switch IC 9 are turned on. However, since the supply of the front channel signal to the front speaker is interrupted by the switch SW4 in the switch IC 9, the switch SW1 may remain on.

In the embodiment, the switch SW1 is connected between the first amplifying unit 4*a* and the front speaker output terminal 6, the switch SW2 is connected between the second amplifying unit 4*b* and the surround speaker output terminal 7, and the switch SW3 is connected between the third amplifying unit 4*c* and the headphone output terminal 8. However, the present invention is not limited to the configuration. For example, the switch SW1 may be connected between the first volume control unit 3*a* and the first amplifying unit 4*a* so that the path extending from the first volume control unit 3*a* to the first amplifying unit 4*a* can be switched to the connection state or the non-connection state. The switch SW2 may be connected between the second volume control unit 3*b* and the second amplifying unit 4*b* so that the path from the second volume control unit 3*b* to the second amplifying unit 4*b* can be switched to the connection state or the non-connection state. The switch SW3 may be connected between the second volume control unit 3*b* and the third amplifying unit 4*c* so that the path extending from the second volume control unit 3*b* to the third amplifying unit 4*c* can be switched to the connection state or the non-connection state. The on/off control of the switches SW1 to SW3 is similar to that in the foregoing embodiment.

Although the embodiment of the present invention has been described above, the foregoing embodiment is just an example for carrying out the invention. Therefore, the present invention is not limited to the foregoing embodiment but can be carried out by properly modifying the foregoing embodiment without departing from the gist of the invention.

The multichannel amplifier of the present invention can be used for electronic devices of any applications and is particularly suitably used for an acoustic device or the like.

What is claimed is:

1. A multichannel amplifier comprising:

a first input terminal to which a front channel signal is inputted;

a second input terminal to which a surround channel signal is inputted;

a first volume control unit to which the front channel signal is inputted and which controls level of the front channel signal;

a second volume control unit to which the front channel signal or the surround channel signal is inputted and which controls level of the front channel signal or the surround channel signal;

a first amplifying unit connected to the first volume control unit, amplifying the front channel signal supplied from the first volume control unit, and outputting the amplified front channel signal to a front speaker;

a second amplifying unit connected to the second volume control unit, amplifying the surround channel signal supplied from the second volume control unit, and outputting the amplified surround channel signal to a surround speaker;

a third amplifying unit connected to the second volume control unit in parallel with the second amplifying unit and amplifying the front channel signal supplied from the second volume control unit;

a headphone output terminal to which a headphone can be connected and from which the front channel signal supplied from the third amplifying unit is outputted;

a first switch unit for switching a first path extending from the first input terminal to the front speaker via the first volume control unit and the first amplifying unit to a connection state or a non-connection state;

a second switch unit for switching a second path extending from the first input terminal to the second volume control unit to the connection state or the non-connection state;

a third switch unit for switching a third path extending from the second input terminal to the second volume control unit to the connection state or the non-connection state;

a fourth switch unit for switching a fourth path extending from the second volume control unit to the surround speaker via the second amplifying unit to the connection state or the non-connection state;

a fifth switch unit for switching a fifth path extending from the second volume control unit to the headphone output terminal via the third amplifying unit to the connection state or the non-connection state; and a control unit for controlling switching between the connection state and the non-connection state of the first to fifth paths based on whether the headphone is connected to the headphone output terminal or not, wherein when the headphone is not connected to the headphone output terminal, the control unit controls the first and second switch units so that the first path is in the connection state and the second path is in the non-connection state.

2. The multichannel amplifier according to claim 1, comprising a sixth switch unit for switching connection between the first input terminal and the first volume control unit to the connection state or the non-connection state and, when the headphone is connected to the headphone output terminal, the sixth switch unit and the second to fifth switch units are controlled so that the first path, the third path, and the fourth path enter the non-connection state, and the second path and the fifth path enter the connection state.

3. The multichannel amplifier according to claim 2, further comprising a first buffer circuit connected between the first input terminal and the sixth switch unit and the second switch unit, a second buffer circuit connected between the sixth switch unit and the first volume control unit, a third buffer circuit connected between the second input terminal and the third switch unit, and a fourth buffer circuit connected between the second and third switch units and the second volume control unit.

* * * * *